US007508409B2

(12) United States Patent
Yoo

(10) Patent No.: US 7,508,409 B2
(45) Date of Patent: Mar. 24, 2009

(54) DRIVE CONTROL DEVICE FOR USE IN AN IMAGE FORMING APPARATUS

(75) Inventor: Si-hun Yoo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 165 days.

(21) Appl. No.: 11/370,876

(22) Filed: Mar. 9, 2006

(65) Prior Publication Data

US 2006/0226801 A1 Oct. 12, 2006

(30) Foreign Application Priority Data

Mar. 22, 2005 (KR) ..... 10-2005-0023652

(51) Int. Cl.
*B41J 29/00* (2006.01)

(52) U.S. Cl. ..... 347/247

(58) Field of Classification Search ..... 347/234, 347/247

See application file for complete search history.

(56) References Cited

U.S. PATENT DOCUMENTS 7,122,767 B2 * 10/2006 Sato et al. ..... 219/497

FOREIGN PATENT DOCUMENTS

| | | | |
|---|---|---|---|
| JP | 04069669 A | * | 3/1992 |
| JP | 06219017 A | * | 8/1994 |
| JP | 11-202722 | | 7/1999 |
| JP | 2002-223407 | | 8/2002 |
| KR | 124421 | | 6/1998 |
| KR | 2000-10058 | | 6/2000 |

OTHER PUBLICATIONS

Howitz & Hill, The Art Of Electronics, 1989, Cambridge University Press, 2nd Edition, pp. 63-64.*

* cited by examiner

*Primary Examiner*—Huan H Tran
(74) *Attorney, Agent, or Firm*—Stein, McEwen & Bui, LLP

(57) ABSTRACT

A drive control device for use in an image forming apparatus comprises: a cover sensing unit which detects the opening of a cover of the image forming apparatus; a relay unit which controls supplement of a voltage for driving a laser scanning unit; and a relay operation control unit which controls the operation of the relay unit in response to the detected result of the cover sensing unit. Accordingly, the drive control device of the image forming apparatus can control operation of one or more driving motors and the laser scanning unit at low cost.

22 Claims, 3 Drawing Sheets

DRIVE CONTROL DEVICE FOR USE IN AN IMAGE FORMING APPARATUS

CROSS-REFERENCE TO RELATED APPLICATIONS

This application claims all benefits accruing under 35 U.S.C §119 from Korean Patent Application No. 10-2005-0023652, filed on Mar. 22, 2005, in the Korean Intellectual Property Office, the disclosure of which is incorporated by reference herein.

BACKGROUND OF THE INVENTION

1. Field of the Invention

The present invention relates to an image forming apparatus, and more particularly, to a drive control device for controlling the drive of an image forming motor and a laser scanning unit in an image forming apparatus.

2. Related Art

In general, an image forming apparatus, such as, a printer, a facsimile machine, a photocopier and a multi-functional product, is typically provided with an engine driving unit, a laser scanning unit, and a control unit operable with a control panel. Typically, the engine driving unit is provided with one or more driving motors for driving one or more components, such as a conveying unit, a photosensitive body such as a photoreceptor drum, a developer unit, a fusing unit, a discharging unit and the like, to form an image on a printable medium with a certain process speed. One or more driving motors are connected to each of the units through a power transmitting gear train and are driven by a power switching device. The laser scanning unit is provided with one or more laser sources and a support structure to scan a laser beam to form an electrostatic latent image on the photosensitive body. Such a laser scanning unit is also driven by a power switching device.

Conventional power switching devices can be costly to install, and can drive the cost of such an image forming apparatus unnecessarily. In generally, there are different types of power switching devices used to drive the laser scanning unit (LSU) and the one or more driving motors in the image forming apparatus.

FIG. 1 is a block diagram of a first typical drive control device for use in an image forming apparatus. As shown in FIG. 1, a first power switch 10 and a second power switch 30, which are mechanical switches, are arranged to control the drive of a laser scanning unit (LSU) 20 and one or more driving motors 40. Typically, the first switch 10 receives a voltage of 5 V from a power source, and controls the drive of the laser scanning unit (LSU) 20 by a switching operation to scan a laser beam including data information for forming an electrostatic latent image on a photosensitive body. In addition, the second power switch 30 receives a voltage of 24 V from another power source, and controls the drive of the one or more driving motors 40 by a switching operation to form an image on a printable medium. The first power switch 10 and the second power switch 30 turn off the voltage supplied to the laser scanning unit 20 or the one or more driving motors 40, when a cover of the image forming apparatus is opened or a developer cartridge is detached from the image forming apparatus.

FIG. 2 is a block diagram of a second typical drive control device for use in an image forming apparatus. A third power switch 50, which is a mechanical switch, and a regulator 70 are arranged to control the drive of one or more driving motors 60 and a laser scanning unit 80, respectively. That is, the third power switch 50 receives a voltage of 24 V from a power source, and controls the drive of the one or more driving motors 60 and the laser scanning unit 80 by a switching operation. The third switch 50 blocks the voltage supplied to the laser scanning unit 80 and the one or more driving motors 60, when the cover of the image forming apparatus is opened or the developer cartridge is detached from the image forming apparatus. The regulator 70 is used to lower the voltage from 24 V to 5 V, and supplies the voltage of 5 V to the laser scanning unit 80.

If two mechanical switches are used, as shown in FIG. 1, or a single mechanical switch and a regulator are used as shown in FIG. 2, cost of the device for controlling the laser scanning unit and the one or more driving motors in an image forming apparatus increases.

Moreover, if the regulator is utilized in the second drive control device, as shown in FIG. 2, additional heat is generated from such a regulator and, as a result, an additional device or structure for sinking the heat is required.

SUMMARY OF THE INVENTION

Various aspects and example embodiments of the present invention provide a new drive control device for use in an image forming apparatus which can inexpensively control the drive of a laser scanning unit (LSU) and one or more driving motors.

Additional aspects and/or advantages of the invention will be set forth in part in the description which follows and, in part, will be obvious from the description, or may be learned by practice of the invention.

In accordance with an aspect of the present invention, a drive control device for use in an image forming apparatus comprises: a cover sensing unit which detects the opening of a cover of the image forming apparatus; a relay unit which controls the supplement of a voltage for driving a laser scanning unit; and a relay operation control unit which controls the operation of the relay unit in response to the detected result of the cover sensing unit.

According to an aspect of the present invention, the cover sensing unit detects that the cover is opened when the voltage for driving one or more driving motors is blocked, and includes at least one resistor which divides the voltage for driving one or more driving motors.

According to an aspect of the present invention, the relay unit supplies the voltage to the laser scanning unit when the relay operation control unit is turned on, and includes one of a transistor and an integrated circuit (IC) arranged to relay the voltage for driving the laser scanning unit.

According to an aspect of the present invention, an equipment installation sensing unit is further provided to detect whether a developer for developing an image is installed in the image forming apparatus; and a logical product unit is arranged to logically combine the detected result of the cover sensing unit and the detected result of the equipment installation sensing unit. Such an equipment installation sensing unit detects that the developer is detached from the image forming apparatus when current flow is blocked.

In accordance with another aspect of the present invention, a drive control device comprises a switch operable to supply a first voltage for driving one or more driving motors, when a cover of an image forming apparatus is closed; a voltage divider connected to the switch, to divide the first voltage and supply a divided voltage; a relay unit arranged to supplement the divided voltage for driving a laser driving unit of the image forming apparatus; and a relay operation control unit arranged to control the operation of the relay unit in response to the divided voltage.

The relay operation control unit corresponds to a transistor having principle electrodes connected between the relay unit and a ground terminal, and a control electrode connected to receive the divided voltage. The relay unit comprises a coil arranged to serve as a magnet when a current flows therein, and a switch arranged in parallel to the coil to supply a second voltage for driving the laser scanning unit. In addition, an equipment installation sensing unit is further provided to determine whether a developer is installed in the image forming apparatus; and a logic gate is arranged to logically combine the divided voltage and a result of the equipment installation sensing unit and to generate a combined result to the relay operation control unit.

In addition to the example embodiments and aspects as described above, further aspects and embodiments of the present invention will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE INVENTION

Figure 1:
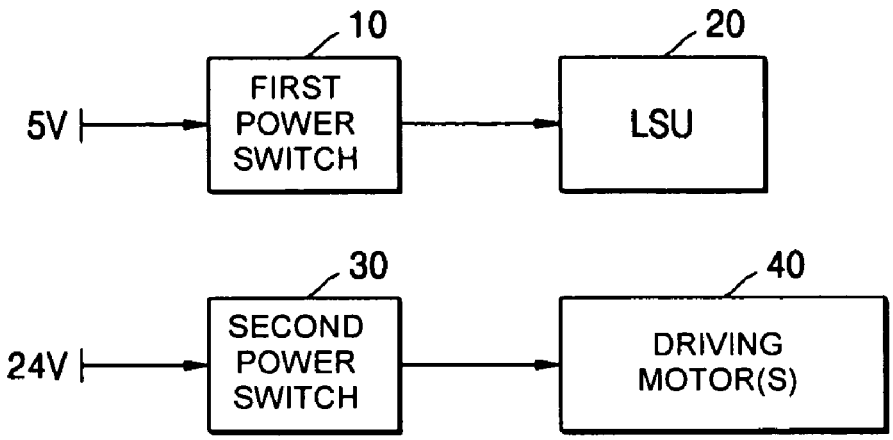
FIG. 1 is a block diagram of a first typical drive control device for use in an image forming apparatus.
Figure 2:
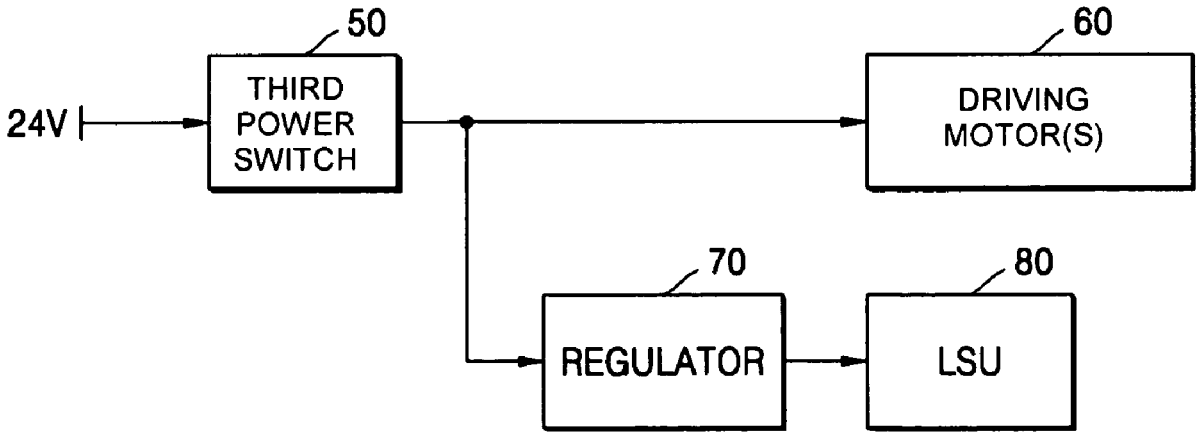
FIG. 2 is a block diagram of a second typical drive control device for use in an image forming apparatus.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 3:
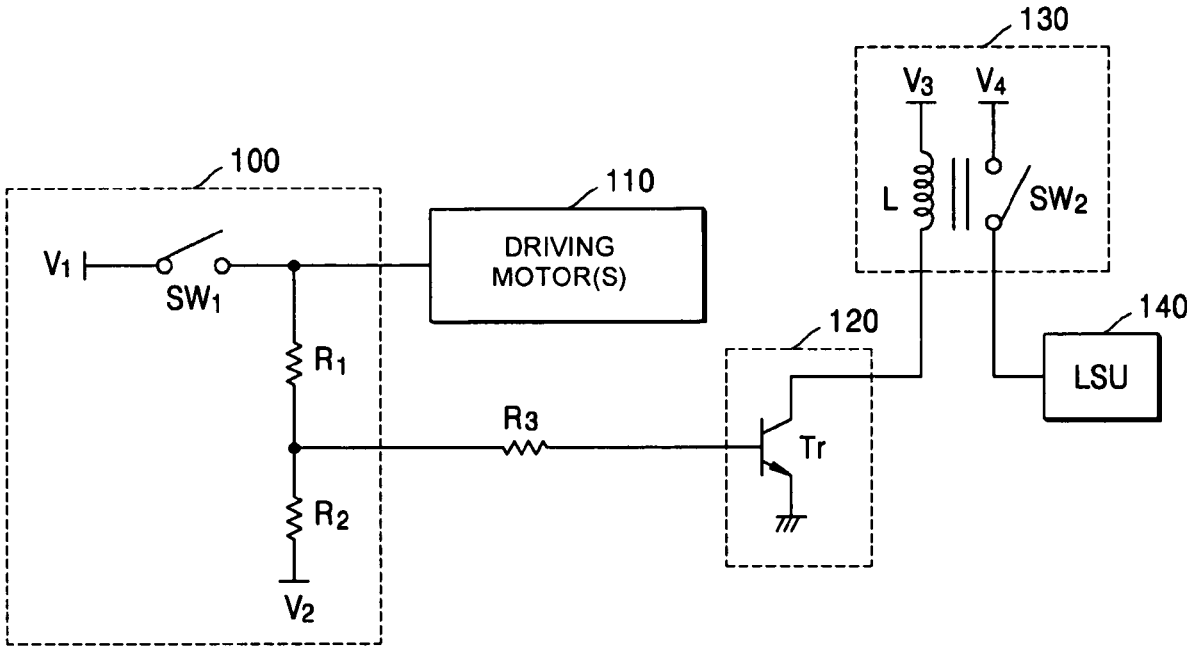
FIG. 3 is a block diagram of a drive control device for use in an image forming apparatus according to an embodiment of the present invention.

FIG. 3 is a block diagram of an example drive control device for use in an image forming apparatus according to an embodiment of the present invention. As shown in FIG. 3, the drive control device includes a cover sensing unit 100, one or more driving motors 110, a relay operation control unit 120, a relay unit 130, and a laser scanning unit 140.

The cover sensing unit 100 detects the opening of a cover (not shown) of the image forming device, and outputs the detected result to the relay operation control unit 120.

The cover sensing unit 100 detects that the cover is opened, when a voltage for driving the one or more driving motors 110 is blocked. For example, when the cover of the image forming apparatus is opened, a switch SW1 of the cover opening sensing unit 100 is turned off to block a voltage V1 supplied to the one or more driving motors 110. When the cover of the image forming apparatus is closed, the switch SW1 of the cover opening sensing unit 100 is turned on to supply the voltage V1 to the one or more driving motors 110. Thus, the one or more driving motors 110 are driven to enable an image formation on a printable medium.

The cover sensing unit 100 includes at least one resistor for dividing the voltage for driving the one or more driving motors 110. For example, the cover sensing unit 100 includes resistors R1 and R2 arranged in series for dividing the voltage V1 and supplying the divided voltage to the relay operation control unit 120.

The driving motors 110 may include a variety of motors which are interconnected and are driven for forming an image.

The relay operation control unit 120 controls the operation of the relay unit 130 in response to the detected result of the cover sensing unit 100.

Particularly, the relay operation control unit 120 includes any one of a transistor and an integrated circuit (IC) logic for controlling the operation of the relay unit 130. For example, the relay operation control unit 120 includes a transistor Tr having principle electrodes (i.e., collector and emitter) connected between the relay unit 130 and ground and a control electrode (i.e., gate) connected to the cover sensing unit 100.

The relay operation control unit 120 is turned on, when the cover sensing unit 100 detects that the cover is closed. That is, when the cover is closed, the switch SW1 of the cover sensing unit 100 is turned on, and thus the relay operation control unit 120 is turned on. When the relay operation control unit 120 is turned on, current flows through the relay operation control unit 120 and thus an electromagnetic force is generated in the relay unit 130. When the cover is opened, the switch SW1 of the cover sensing unit 100 is turned off, and thus the relay operation control unit 120 is turned off. When the relay operation control unit 120 is turned off, current does not flow through the relay operation control unit 120, and thus an electromagnetic force is not generated in the relay unit 130.

The relay unit 130 controls the supplement of the voltage for driving the laser scanning unit 140 according to the relay operation control unit 120. The relay unit 130 includes a coil L connected to receive a voltage V3 and a switch SW2 connected to receive a voltage V4. The coil L serves as a magnet when current flows in the coil L, when current flows through the relay operation control unit 120. When the coil L becomes the magnet, the relay unit 130 attracts the switch SW2, and thus supplies the voltage V4 to the laser scanning unit 140. That is, the relay unit 130 performs a switching function.

For example, when the transistor Tr of the relay operation control unit 120 is turned on, the current flows in the coil L of the relay unit 130, and thus the electromagnetic force is generated. Accordingly, the switch SW2 is turned on by the electromagnetic force, and thus the voltage V4 which is used as a driving source of the laser scanning unit 140 is supplied to the laser scanning unit 140. When the transistor Tr of the relay operation control unit 120 is turned off, the current does not flow in the coil L of the relay unit 130 and thus the electromagnetic force is not generated. Accordingly, the switch SW2 is turned off, and thus the voltage V4 which is used as the driving source of the laser scanning unit 140 is not supplied to the laser scanning unit 140.

Figure 4:
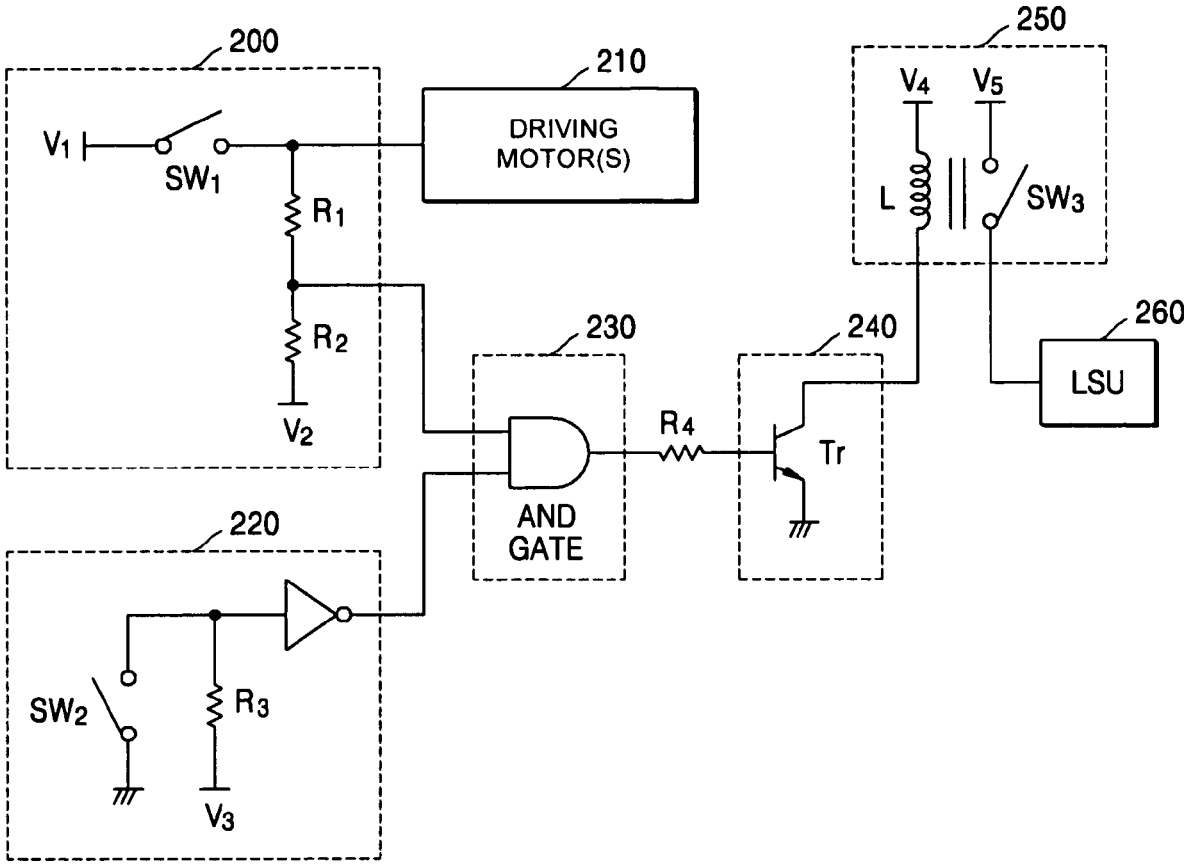
FIG. 4 is a block diagram of a drive control device for use in an image forming apparatus according to another embodiment of the present invention.

FIG. 4 is a block diagram of a drive control device of an image forming apparatus according to another embodiment of the present invention. As shown in FIG. 4, the drive control device according to the present embodiment includes a cover sensing unit 200, one or more driving motors 210, an equipment installation sensing unit 220, a logical product unit 230, a relay operation control unit 240, a relay unit 250, and a laser scanning unit 260.

The cover sensing unit 200, the one or more driving motors 210, the relay operation control unit 240, the relay unit 250, and the laser scanning unit 260 correspond to the cover opening sensing unit 100, the one or more driving motors 110, the relay operation control unit 120, the relay unit 130, and the laser scanning unit 140 shown in FIG. 3, respectively, and thus their description will be described. Hereinafter, the equipment installation sensing unit 220 and the logical product unit 230 will be described in detail.

The equipment installation sensing unit 220 detects whether a developer for developing an image (not shown) is installed in the image forming apparatus, and outputs the detected result to the logical product unit 230. The equipment installation sensing unit 220 includes a switch SW2 for detecting whether the developer is installed. The switch SW2 is turned on when the developer is installed in the image forming apparatus, and is turned off when the developer is detached from the image forming apparatus. Particularly, the developer may include a conductor chip for performing a switching function at a predetermined location thereof.

The logical product unit 230 performs a logical product of the detected result of the cover sensing unit 200 and the detected result of the equipment installation sensing unit 220, and outputs the logical product result to the relay operation control unit 240. The logical product unit 230 includes a logic gate, such as an AND gate, for performing the logical product.

Table 1 shows the logical product operation as follows.

TABLE 1

| Input | | Output |
|---|---|---|
| Cover | Developer | Logical product result |
| Opening (L) | Detached (L) | L |
| Opening (L) | Installed (H) | L |
| Closing (H) | Detached (L) | L |
| Closing (H) | Installed (H) | H |

As shown in Table 1, the logical product unit 230 outputs a low signal L when it receives the result (low signal L) indicating that the cover of the cover opening sensing unit 200 is opened and the result (low signal L) indicating that the developer is detached from the equipment installation sensing unit 220. The logical product unit 230 outputs the low signal L when it receives the result (low signal L) indicating that the cover of the cover sensing unit 200 is opened and the result (high signal H) indicating that the developer is installed in the equipment installation sensing unit 220. Also, the logical product unit 230 outputs the low signal L when it receives the result (high signal H) indicating that the cover of the cover sensing unit 200 is closed and the result (low signal L) indicating that the developer is detached from the equipment installation sensing unit 220.

When the logical signal of the logical product unit 230 is the low signal (L), the transistor Tr of the relay operation control unit 240 is turned off.

The logical product unit 230 outputs a high signal H when it receives the result (high signal H) indicating that the cover of the cover sensing unit 200 is closed and the result (high signal H) indicating that the developer is installed in the equipment installation sensing unit 220.

When the logical signal of the logical product unit 230 is the high level H, the transistor Tr of the relay operation control unit 240 is turned on.

When the transistor Tr of the relay operation control unit 240 is turned on, a switch SW3 of the relay unit 250 is turned on and a voltage V5 for driving the laser scanning unit 260 is supplied to the laser scanning unit 260.

When the transistor Tr of the relay operation controlling unit 240 is turned off, the switch SW3 of the relay unit 250 is turned off and the voltage V5 for driving the laser scanning unit 260 is not supplied to the laser scanning unit 260.

As mentioned above, the drive control device for use in an image forming apparatus according to the present invention can control the laser scanning unit and one or more driving motors at low cost and can design the equipment, regardless of the location of the mechanical switch. One or more voltage terminals may be utilized to provide voltages, such as V1, V2, V3, V4 and V5, as shown in FIG. 3 and FIG. 4. V1 may be different from V2; however, V3 and V4, as shown in FIG. 3, and V3, V4 and V5, as shown in FIG. 4, can be the same voltage.

While the drive control device of the image forming apparatus of the present invention has been particularly shown and described with reference to exemplary embodiments thereof, it will be understood by those of ordinary skill in the art that various changes in form and details may be made therein without departing from the spirit and scope of the present invention. For example, components of driving motors and a laser scanning unit (LSU) can be arranged differently. In addition, different simple integrated circuits (ICs) can be designed to control drive operations of the one or more driving motors and the laser scanning unit to reduce cost. Accordingly, it is intended, therefore, that the present invention not be limited to the various example embodiments disclosed, but that the present invention includes all embodiments falling within the scope of the appended claims.

What is claimed is:

1. A drive control device for use in an image forming apparatus comprising:

a cover sensing unit which detects whether a cover of the image forming apparatus is closed, which supplies a first voltage to one or more driving motors of the image forming apparatus when the cover is closed, and which generates a divided voltage based on the first voltage;

a relay unit which controls supply of a second voltage for driving a laser scanning unit; and a relay operation control unit which controls the operation of the relay unit in response to the detected result of the cover sensing unit.

2. The device according to claim 1, wherein the cover sensing unit detects that the cover is opened when the first voltage for driving one or more driving motors is blocked.

3. The device according to claim 1 wherein the cover sensing unit includes at least one resistor which divides the first voltage for driving one or more driving motors.

4. The device according to claim 1, wherein the relay unit supplies the second voltage to the laser scanning unit when the relay operation control unit is turned on.

5. The device according to claim 1, wherein the relay operation control unit includes one of a transistor and an integrated circuit (IC) arranged to relay the divided voltage for controlling driving of the laser scanning unit.

6. The device according to claim 1, further comprising;

an equipment installation sensing unit which detects whether a developer for developing an image is installed in the image forming apparatus; and a logical product unit which performs logic product of the detected result of the cover sensing unit and the detected result of the equipment installation sensing unit.

7. The device according to claim 6, wherein the equipment installation sensing unit detects that the developer is detached from the image forming apparatus when current flow is blocked.

8. The device according to claim 6, wherein the logical product unit includes a logic AND gate.

9. The device according to claim 6, wherein the cover sensing unit detect that the cover is opened when the first voltage for driving one or more driving motors is blocked.

10. The device according to claim 6, wherein the cover sensing unit includes at least one resistor which divides the first voltage for driving one or more driving motors.

11. The device according to claim 6, wherein the relay unit supplies the second voltage to the laser scanning unit when the relay operation control unit is turned on.

12. The device according to claim 6, wherein the relay operation control unit includes one of a transistor and an integrated circuit (IC) arranged to relay the divided voltage for controlling driving of the laser scanning unit.

13. A drive control device comprising:

a switch operable to supply a first voltage for driving one or more driving motors, when a cover of an image forming apparatus is closed;

a voltage divider connected to the switch, to divide the first voltage and supply a divided voltage;

a relay unit arranged to supply a second voltage for driving a laser scanning unit of the image forming apparatus; and a relay operation control unit arranged to control the operation of the relay unit in response to the divided voltage.

14. The drive control device according to claim 13, wherein the relay operation control unit corresponds to a transistor having principle electrodes connected between the relay unit and a ground terminal, and a control electrode connected to receive the divided voltage.

15. The drive control device according to claim 13, wherein the relay unit comprises a coil arranged to serve as a magnet when the current flows therein, and a switch arranged in parallel to the coil to supply the second voltage for driving the laser scanning unit.

16. The drive control device according to claim 13, further comprising:

an equipment installation sensing unit arranged to determine whether a developer is installed in the image forming apparatus; and a logic gate arranged to logically combine the divided voltage and a result of the equipment installation sensing unit and to generate a combined result to the relay operation control unit.

17. The drive control device according to claim 16, wherein the equipment installation sensing unit corresponds to a switch operable to supply a voltage when the developer is installed in the image forming apparatus.

18. A drive control device comprising:

a cover sensing unit arranged to determine whether a cover of an image forming apparatus is closed, and to supply a first voltage for driving one or more driving motors when the cover of an image forming apparatus is closed, and which generates a divided voltage based on the first voltage;

a relay unit arranged to supply a second voltage for driving a laser scanning unit of the image forming apparatus; and a relay operation control unit arranged to control the operation of the relay unit when the cover of the image forming apparatus is closed.

19. The drive control device according to claim 18, wherein the relay operation control unit corresponds to a transistor having principle electrodes connected between the relay unit and a ground terminal, and a control electrode connected to receive the voltage from the cover sensing unit.

20. The drive control device according to claim 18, wherein the relay unit comprises a coil arranged to serve as a magnet when the current flows therein, and a switch arranged in parallel to the coil to supply the second voltage for driving the laser scanning unit.

21. The drive control device according to claim 19, further comprising:

an equipment installation sensing unit arranged to determine whether a developer is installed in the image forming apparatus; and a logic gate arranged to logically combine the divided voltage and a result of the equipment installation sensing unit and to generate a combined result to the relay operation control unit.

22. The drive control device according to claim 19, wherein the equipment installation sensing unit corresponds to a switch operable to supply a voltage when the developer is installed in the image forming apparatus.

* * * * *